US006953167B2

(12) United States Patent
Strong

(10) Patent No.: US 6,953,167 B2
(45) Date of Patent: Oct. 11, 2005

(54) WOOD CHIPPER KNIFE HOLDER SYSTEM FOR A POWER DRIVEN ROTOR HEAD

(75) Inventor: James L. Strong, Remus, MI (US)

(73) Assignee: Morbark, Inc., Winn, MI (US)

( * ) Notice: Subject to any disclaimer, the term of this patent is extended or adjusted under 35 U.S.C. 154(b) by 215 days.

(21) Appl. No.: 10/439,511

(22) Filed: May 16, 2003

(65) Prior Publication Data

US 2004/0089754 A1 May 13, 2004

Related U.S. Application Data

(60) Provisional application No. 60/381,623, filed on May 17, 2002.

(51) Int. Cl.[7] ..... B02C 18/18

(52) U.S. Cl. ..... 241/92; 29/428; 144/176; 241/298

(58) Field of Search ..... 29/428; 144/176; 241/92, 296, 298, 294, 29

(56) References Cited

U.S. PATENT DOCUMENTS 5,271,440 A * 12/1993 Bradstreet et al. ..... 144/176
5,501,256 A * 3/1996 Dyer et al. ..... 144/241
5,820,042 A * 10/1998 Robison ..... 241/92

* cited by examiner

*Primary Examiner*—Mark Rosenbaum
(74) *Attorney, Agent, or Firm*—Reising, Ethington, Barnes, Kisselle & Learman, PC

(57) ABSTRACT

A wood chipper knife holder assembly for a power driven rotor head has at least one opening in its wood confronting surface for the knife holder assembly which includes a mount block. A counter-knife receiving surface opposite the wood confronting surface of the rotor head is provided on the mount block for a counter-knife and a reversible knife blade is received on the counter-knife. A clamp member secures to clamp the knife in a projecting cutting position. The clamp member and knife have transversely spaced openings and pins which permit 180° repositioning of the knife to present a fresh knife cutting edge, and the clamp member has a transverse surface for receiving the rearward cutting edge of the knife.

12 Claims, 3 Drawing Sheets

WOOD CHIPPER KNIFE HOLDER SYSTEM FOR A POWER DRIVEN ROTOR HEAD

This application claims the priority of U.S. Provisional Application Ser. No. 60/381,623, filed May 17, 2002.

BACKGROUND OF THE INVENTION

The present invention relates to improvements in knife holder systems employing a reversible knife and counter-knife of the type which are housed in openings provided in wood chipping rotor heads, such as chipper discs.

The invention relates particularly to an improved knife holder of the character described in applicant's U.S. Pat. No. 5,820,042 issued Oct. 13, 1998, which I incorporate herein by reference.

The present improvement is likewise concerned with the utilization of low cost, disposable, reversible chipper knives clamped to a counter-knife which is secured within a knife holder assembly. It is particularly concerned with providing a structure and method which is capable of alterating the chip size without affecting the geometry of the hardware required to manufacture quality chips. In some industries, such as the pulp wood industry, it is necessary that the chips produced be of a consistent particular length and, also, of a predetermined thickness and width.

Prior art disposable knife systems have installed shims and/or plates between the underside of the tool holder and the mounting surface of the disc to elevate the tool holder and its related parts relative to the disc to seek to manufacture a predetermined size of chip. This is, for many reasons, not the best or most consistent way to manufacture a chip of predetermined size.

SUMMARY OF THE INVENTION

The invention is concerned with the employment of a low cost, double-edged, throwaway reversible knife having flat upper and lower surfaces and a configuration which provides for beveled cutting edges on both ends of the knife, as in the patent identified. It is desirable that the knives provide a pair of transverse linear cutting edges which can be interchanged by turning the knife end for end, once one edge becomes worn, dulled or damaged with use. It is important that the knives are usable with a standard manufactured chipper disc or other powered knife holder assembly and that the holder assembly be readily retrofittable into machines which already are in the field in use. Thus, the holder system, which will be described, employs a throwaway knife and counter-knife, along with a removable clamp member for releasably clamping the knife in a cutting position in which one of its cutting edges or ends projects forwardly beyond the counter-knife.

In the present case, the knife is not fastened to the counter-knife as in the patent mentioned, but is, instead, releasably secured to the clamp member. The clamp member and knife have aligned pins and pin openings to permit a 180° repositioning of the knife, and pins received in such pin openings, mount the knife to the clamp member in both an original and in a 180° reversed and flipped-over position. The clamp member has a step for receiving the rearward transverse edge of the knife and locating the knife in cutting position.

One of the prime objects of the present invention is to provide a system permitting a single, relatively unskilled workman to reverse or change the individual knives from the wood confronting side of the disc by simply backing off the clamp plate, removing the knife plate from the clamp plate and, after inverting it, rotating it 180° along its longitudinal axis, before remounting it on the clamp plate pins and tightening the clamp plate down once again. When it is desired that chips of a different size are to be produced, the clamp plate, which is manufactured in various sizes and dictates the cutting edge projection in relation to the wood confronting side of the disc, may be readily replaced by simply removing the clamp plate and replacing it with a clamp plate having a differently located cylindrical pin opening and step location. This capability enables a particular different chip length to be manufactured without affecting any of the other related hardware. Further, when the leading counter-knife edges becomes worn, it is a relatively simple matter to back off the fasteners holding the counter-knives and reverse the counter-knives before replacing and reinstalling the knife blades.

A prime object of the invention is to provide a holder system which provides the capability of readily changing chip sizes in an economical and simple matter, without detracting from the capability of consistantly producing chips of proper size.

Another object of the invention is to provide a knife holder system which enables the effective use of disposable reversible knife segments without complex changes in the standard hardware.

Still another object of the invention is to provide a chipper system which may be used to chip a wide variety of soft and hard woods, ranging from whole logs and trees to some residual wood and recyclable wood resulting from the demolition of old buildings, for example.

A further object of the invention is to provide a knife holder system which facilitates knife and counter-knife changing from the front of the disc in a fast labor saving and safe manner.

Other objects and advantages of the invention will become apparent with reference to the accompanying drawings and the accompanying descriptive matter.

BRIEF DESCRIPTION OF THE DRAWINGS

The presently preferred embodiment of the invention is disclosed in the following description and in the accompanying drawings, wherein.

DETAILED DESCRIPTION OF THE DRAWINGS

Figure 1:
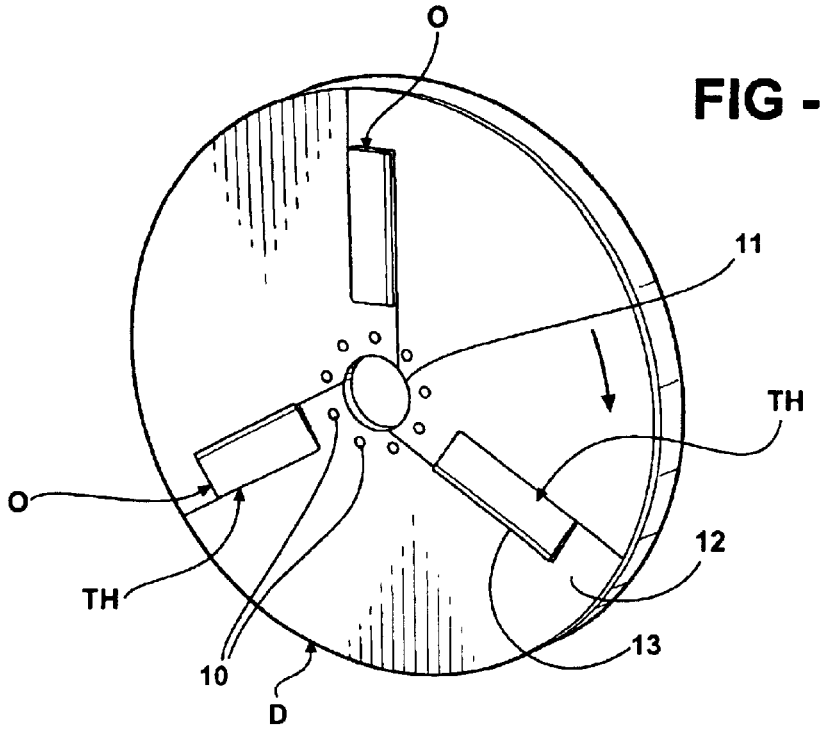
FIG. 1 is a schematic perspective elevational view of a typical rotor head disc.
Figure 2:
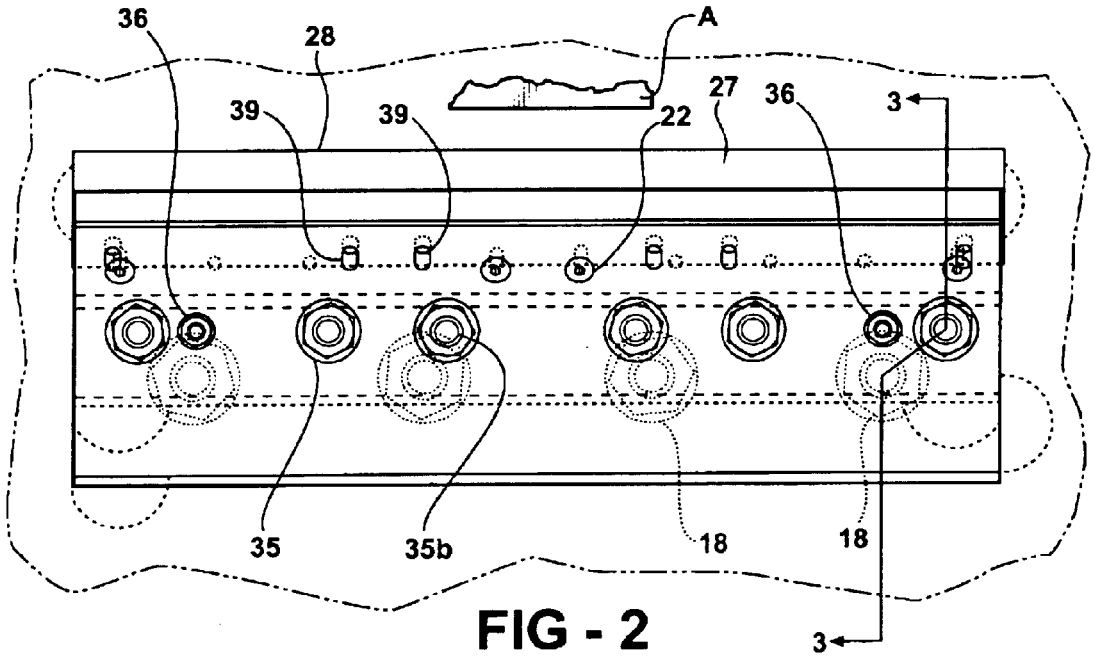
FIG. 2 is an enlarged front face view of a portion of the disc showing a knife holder installed in operative position.
Figure 3:
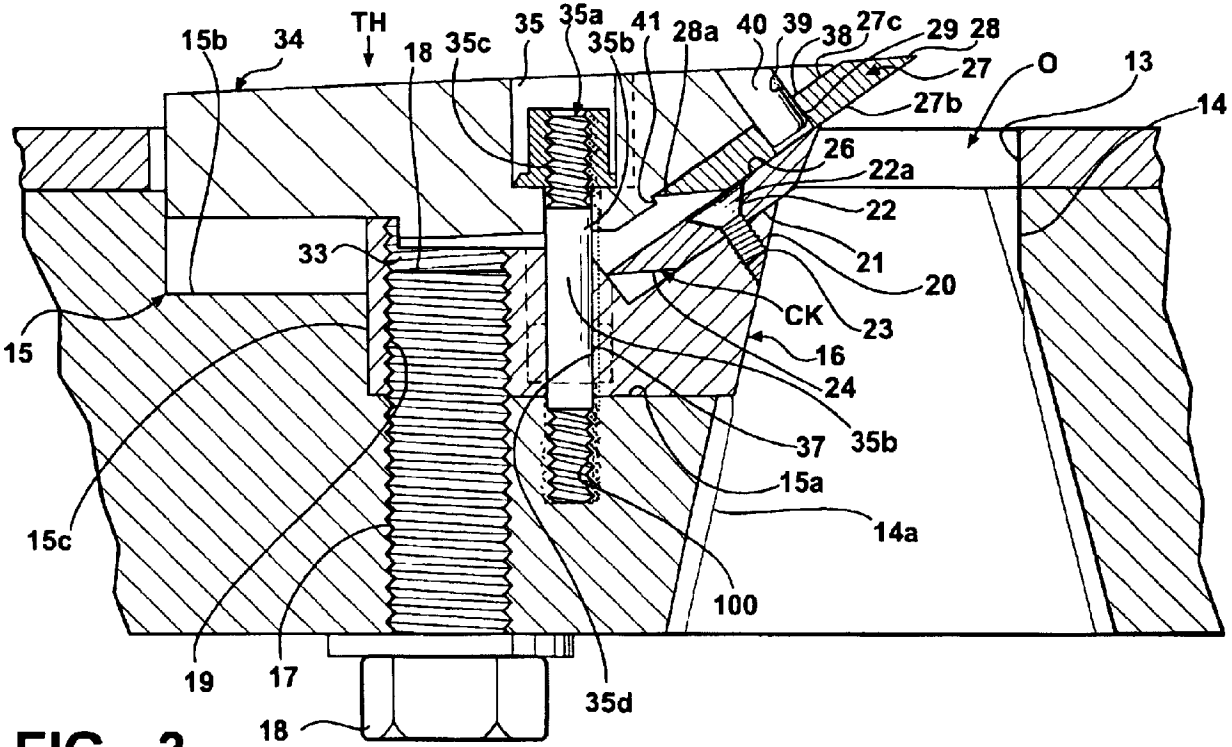
FIG. 3 is a still further enlarged transverse sectional view thereof taken on the line 3—3 of FIG. 2.

Referring now more particularly to the accompanying drawings and in the first instance to FIGS. 1–3, the rotor head or chipper disc, generally indicated at D, is fixed to the flange of a motor driven drive shaft (not shown) in the usual manner, such as by extending bolts or other fasteners through the openings 10, which are provided through the disc D. Alternatively, for some wood, it is believed the openings O could be provided in a chipping drum. Provided in the disc D illustrated, are a trio of circumferentially spaced openings, generally designated O, which are internally configured in the manner indicated in FIG. 3. Within each is a fixedly mounted tool holder system or assembly, generally designated TH, which cooperates in the usual manner with the anvil A and presently will be described in detail.

The disc D is provided with a central opening 11, which receives the drive shaft, and the wood confronting surface of the disc D may be protected by wear-resisting segment covers 12 which are formed with openings 13, generally conforming compositely to the openings O.

Each opening O has a generally radially extending leading marginal wall 14, which is circumferentially spaced from the tool holder system TH sufficiently to form a chip expressing passage 14*a* through which the chips cut pass from the wood confronting front of the disc D to the rear of the disc D in the usual manner. The opening O further has a trailing stepped wall, generally designated 15, which includes an inner shoulder surface 15*a* and an outer shoulder surface 15*b*. A wall 15*c* connects the shoulder surfaces 15*a* and 15*b* and, together the walls 15*a* and 15*c*, provide a seat for a mount block, generally designated 16. Bolt openings 17 in disc D are provided for bolts 18 which thread into the threaded openings 19 in the mount block 16 to releasably fix the tool assembly TH in position.

Figure 4:
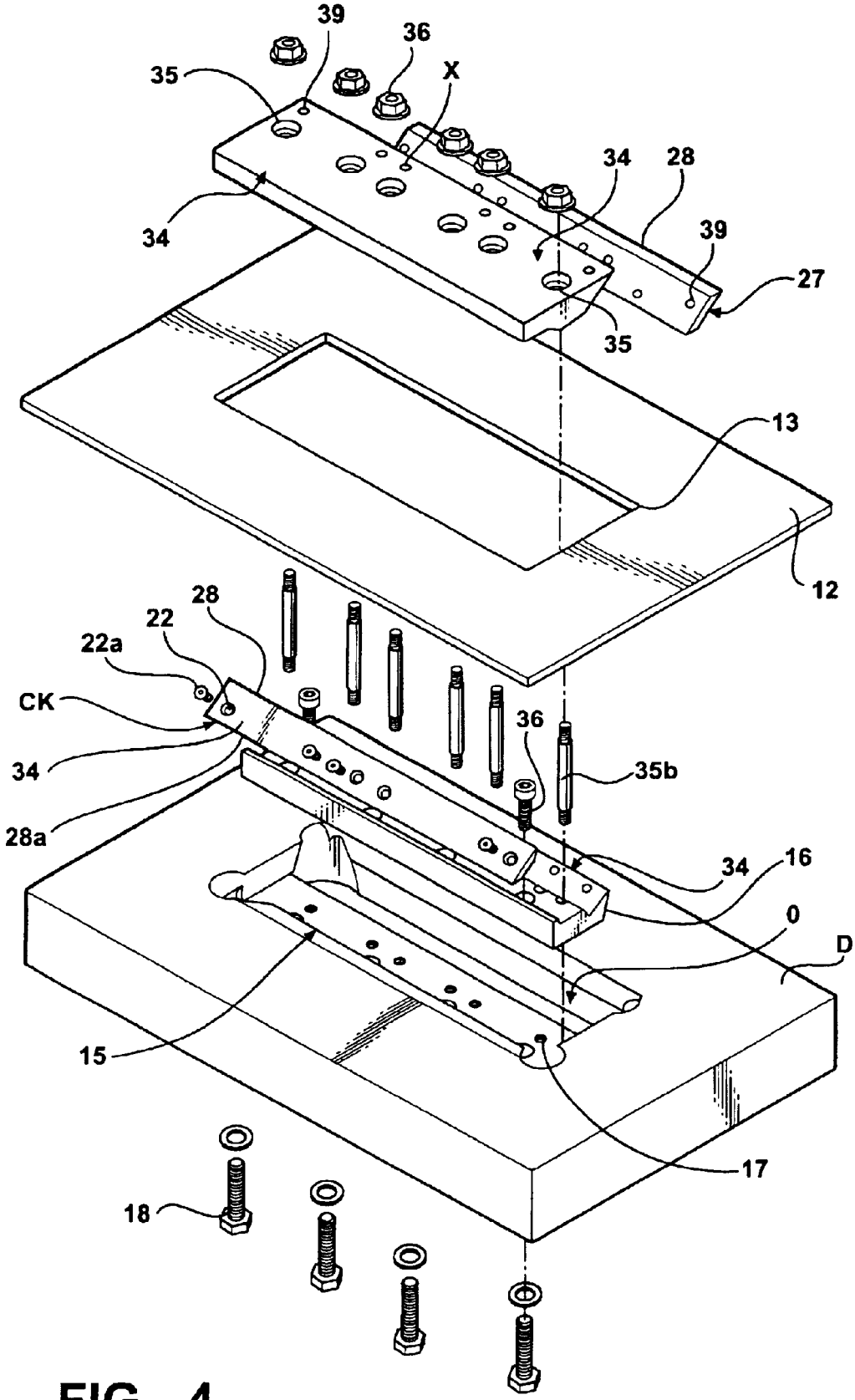
FIG. 4 is an exploded perspective view illustrating the knife holder assembly components.

It will be seen that the inclined front face of mount block 16 is cut away as at 20 to provide a forwardly inclined counter-knife receiving surface 21 at an acute angle relative to the direction of rotation of the cutter disc D and its frontal wood confronting surface. Received on the surface 21 is a counter-knife, generally designated CK, which has a series of countersunk fastener or screw openings 22, for cap screws 22*a*, which extend into threaded openings 23 in the mount block 16 to releasably secure the counter-knife CK in located position. The opposed transverse edges of the counter-knife are acutely oppositely beveled as at 24 in a manner which permits them to be turned 180°, or end for end, when the cap screws 22*a* are backed off. The inner surface of the bladelike counter-knife CK is flatted to conform to the receiving surface 21 and its outer surface 26 is parallelly flatted to receive the cutting knife or blade, generally identified by the numeral 27. As indicted in FIG. 4, the knife 27 is provided in side-by-side segments to permit individual changing or reversing, as may the counter-knife CK be.

Each cutting knife segment 27 is end-beveled to provide a transverse leading cutting edge 28 and is further end-beveled so that the knife can be inverted and turned 180°, or end for end, to present a fresh transverse cutting edge 28*a* to the wood confronting side of the disc D at the appropriate time. Each throwaway knife segment 27 is provided with a completely flat inner face 27*b* and a parallel flat outer surface 27*c*. Each knife blade or knife blade segment includes non-threaded circular openings 29 in its inner or upper face 27*c* which are centrally longitudinally located in the surface 27*c* along an end to end center line x (FIG. 4) equally spaced from the cutting edges of the blade 27 (see FIG. 3).

The mount block 16, in addition to bolts 18, has cap screws 36 (FIG. 2) which extend through to threaded openings 100 provided in the disc D. Also provided in the mount block 16 is a recess 33 for receiving and seating a knife clamp, generally designated 34, which is provided with counterbored openings 35 for receiving fastener assemblies which extend down into threaded openings 37 provided in the mount block 16 to secure the clamp 34 in the position indicated in the drawings and, particularly, FIG. 3. The fastening members each comprise a stud 35*b* threaded at its outer end as at 35*c* and its inner end as at 35*d*. Stud 35*b* threads into the threaded end of opening 37. A readily removable nut 36*a* threads on the threaded outer end of stud 35*a*, while stud rotation is prevented by adhesively or otherwise securing the threads 35*d* in threads 37. The stud 35*b* is normally only removed for replacement purposes when the threads of the stud 35*b* become worn. The purpose is to provide a secure structure for the clamp 34 which will not loosen due to the considerable vibration which occurs, but will provide a maximum flexibility to change knives with minimal labor time.

Provided on the clamp plate 34 is an under-beveled knife receiving clamp surface 38. It will be observed that the clamp plate 34 includes non-threaded circular openings 39 for snugly receiving the pins 40, which extend down to the surface 27*c* of the knife 27 and slidably into the through openings 29. The non-threaded cylindrical pins 40 are received in the circular openings 29 in the knife 27 with some clearance to provide for some shiftability. The pins 40 may be press-fitted into openings 39.

Figure 3A:
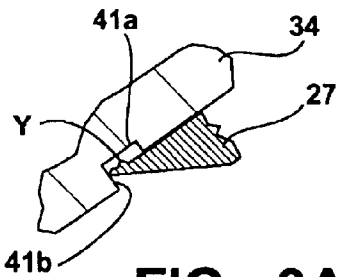
FIG. 3A is a further enlarged fragmentary view similar to FIG. 3 showing a portion of the clamp plate and knife in larger scale.
Figure 3B:
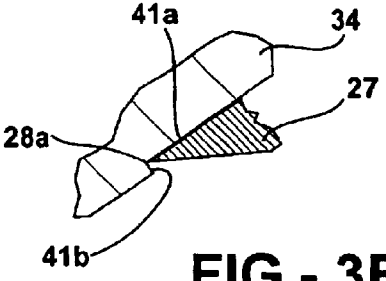
FIG. 3B is a view similar to FIG. 3A of another embodiment.

It will be seen that each clamp plate 34 is undershouldered to provide a step or recess generally designated 41, for receiving the alternative cutting edge 28*a* of the knife 27 and locating the opposed cutting edge 28 in a braced position. The step 41 has angularly disposed surfaces 41*a* and 41*b* as shown in FIG. 3A. In FIG. 3B is an improved embodiment in which surface 41*a* is inset. When a knife 27 is used, metal on the cutting edge tends to be displaced as at y in FIG. 3B. When this edge is reversed to present a fresh cutting edge, the metal y does not interfere with the capability of the entire lateral worn edge of knife 27 to engage wall 41*b*.

The Operation

In practice, chips which are cut by the leading cutting edge 28 in FIG. 3 move through the openings 13 and O to the rear of disc D in the usual manner. The degree of projection of the knife 27 from the wood confronting surface 13 of the disc D and the counter-knife leading edge determines the size of the chips which are produced. The relatively inexpensive blades 27, when dulled, are normally reversed end for end and then, when the edge 28*a* becomes dulled, are not usually further used. Because the counter-knives wear less rapidly, counter knife changes are less frequent than knife changes. In practice, to reverse a knife 27, it is merely necessary to back off the nuts 36*a* and remove the clamp 34 with its pins 40. The knife 27 may then be simply removed from pins 40, reversed end to end, and inverted to present the opposed cutting edge 28*a* as the wood confronting chipping edge, after which the clamp plate 34, with pins 40 reinserted in knife 27, may be replaced and nut 36*a* tightened down.

It is to be understood that the clamp plate 34 is manufactured in different sizes to dictate where the cutting edge 28 is located in relationship to the wood confronting side of the disc D. Simply by removing clamp plate 34 and replacing it with a clamp plate with a different cylindrical pin opening 39 location and step 41 location, a different chip size can be obtained without affecting any of the other related hardware. The structure provides a maximum flexibility to size chips while permitting the same throwaway knives to be used for the various sizes. The non-threaded, non-binding, through knife openings 29 permit the knife 27 to be readily separated from pins 40, when it is desired that the cutting edge 28 be replaced by the cutting edge 28*a*. Because the knives 27 are formed of a harder material, i.e., tool steel, than the clamp plate 34 and the knife surface 27*b* extends linearly from one cutting edge of the tool to the other and contacts the surface 41*a* as well as the surface 41*b*, there is no injury to the knife edge 28*a* when the knife edge 28 is chipping. The openings 29 in knife 27 are large enough with respect to the non-threaded pilot pins 40 to provide some tolerance and it is the knife edge 28*a* which locates the cutting edge 28 to provide the length of chips desired.

It is understood that the disclosed embodiments are representative of presently preferred forms of the invention and that other forms that accomplish the same function are incorporated herein within the scope of the patent claims.

What is claimed is:

1. An improved wood chipper knife holder system for a power driven rotor head having at least one opening in its wood confronting surface for accommodating the system, the system including: a mount block having a counter knife receiving surface; a counter knife received thereon; a reversible knife, with flat opposing surfaces extending from one end to the other end and with opposed front and rear end transverse cutting edges, received on the counter knife; and a removable clamp member releasably secured on the block to clamp the knife in a cutting position in which one of its cutting edges projects forwardly beyond the counter knife; the improvement wherein:

(a) the counter knife is releasably mounted on the counter knife receiving surface;

(b) the clamp member and knife have transversely spaced pins and transversely aligned pin openings which permit 180° repositioning of said knife; and (c) the clamp member has a transverse surface for receiving and back-bracing the rearward transverse cutting edge of the knife, and locating the knife in cutting position.

2. The improvement of claim 1 wherein said clamp member has an outer and an inner side and said transverse surface is provided by a step formed in the inner side of said clamp member.

3. The improvement of claim 2 wherein said knife is a tool steel knife formed with substantially parallel end surfaces connecting said opposed flat surfaces to provide a knife structure which can be flipped over and turned end to end to provide a fresh forwardly disposed cutting edge.

4. The improvement of claim 3 wherein said step is formed with a longitudinal surface and said transverse surface extends angularly therefrom between inner and outer ends; and said rear cutting edge of said knife is positioned to intersect said transverse surface between the inner and outer ends of said transverse surface and provide open space inboard of said rear cutting edge to accommodate a rough surface formed on said rearward cutting edge when it was forwardly disposed in inverse position and performing a chipping operation.

5. The improvement of claim 1 wherein said cutting edges extend in different planes provided on each of said flat surfaces of said cutting knife.

6. The improvement of claim 1 wherein a threaded fastener fixed non-rotatably on said mount block extends through said clamp member and a nut removably secures said clamp member to said fastener so removal of said nut alone permits said clamp member and pins to be lifted from said mount block.

7. A method of constructing a wood chipper knife holder system for a power driven rotor head having at least one opening in its wood confronting surface for accommodating the system, the system including a mount block having a counter knife received thereon, a reversible knife, with flat upper and lower surfaces extending from one end to the other and with front and rear cutting surfaces along opposed end transverse edges received on the counter knife; and a removable clamp member releasably secured on the block to clamp the knife in a cutting position in which one of its ends projects forwardly beyond the counter knife, comprising:

(a) releasably mounting the counter knife on the counter knife receiving surface;

(b) providing the clamp member and knife with transversely aligned pin openings permitting 180° repositioning of said knife;

(c) providing pins received in said pin openings to generally locate said knife with respect to said clamp member in original and 180° reversed position; and (d) providing said clamp member with a recess for receiving said rearward transverse cutting edge, said recess being formed with respect to said rearward cutting edge of the knife to provide a transverse knife edge confronting wall surface bounding an open space above said rear cutting edge.

8. The method of claim 7 including providing said knife as a flip-over knife with parallel end walls extending from cutting edges on its opposed flat surfaces.

9. The method of claim 7 including locating said rear cutting edge in bracing engagement with said confronting wall surface prior to clamping said clamp member down in position.

10. A method of assembling a wood chipper knife system for a power driven rotor head having at least one opening in its wood confronting surface for accommodating the system, the system including: a mount block having a counter knife receiving surface; a counter knife received thereon; a reversible knife, with flat upper and lower surfaces extending from one end to the other end and with opposed oppositely beveled non-parallel ends providing front and rear end transverse cutting edges in different planes, received on the counter knife; and a removable clamp member releasably secured on the block to clamp the knife in a cutting position in which one of its ends projects forwardly beyond the counter knife; the improvement comprising:

(a) securing the counter knife on the counter knife receiving surface;

(b) providing the clamp member and knife with aligned pin openings which permit 180° repositioning of said knife;

(c) providing the underside of the clamp member with a step for receiving the rearward cutting edge of the knife and locating the knife in cutting position;

(d) placing the knife on the counter knife to capture said pins in said openings; and (e) bringing said rear cutting edge into backing engagement with said step and clamping said clamping member down to fix said knife in cutting position.

11. The method of claim 10 wherein said step is formed with respect to said knife to provide a knife edge confronting wall bounding an open space above said rear cutting edge.

12. A wood chipper knife holder system for use with a power driven rotor head having at least one opening in its wood confronting surface for accommodating the system, the system including a mount block having a counter knife receiving surface, a counter knife received thereon, a reversible knife, with front and rear transverse edges received on the counter knife, and a removable clamp member releasably secured on the block to clamp the knife in a cutting position in which one of its ends projects forwardly beyond the counter knife; the improvement comprising:

(a) the clamp member and knife having transversely aligned pin openings provided to permit 180° repositioning of said knife;

(b) pins received in said pin openings to generally locate said knife with respect to said clamp member in original and 180° reversed positions; and (c) said knife holder incorporating a recess with a recess wall for engaging said rear end transverse cutting edges, said recess being formed with respect to said rearward cutting edge of the knife to provide a transverse knife edge confronting wall surface bounding an open space above said rear cutting edge.

* * * * *